US005579095A

United States Patent [19]

Yano et al.

[11] Patent Number: 5,579,095

[45] Date of Patent: Nov. 26, 1996

[54] CHARGING DEVICE

[75] Inventors: Hideyuki Yano; Harumi Ishiyama, both of Yokohama; Tadashi Furuya, Kawasaki; Seiji Mashimo, Tokyo, all of Japan

[73] Assignee: Canon Kabushiki Kaisha, Tokyo, Japan

[21] Appl. No.: 492,526

[22] Filed: Jun. 20, 1995

[30] Foreign Application Priority Data

Jun. 22, 1994 [JP] Japan ..... 6-140180
Jun. 13, 1995 [JP] Japan ..... 7-146240

[51] Int. Cl.[6] ..... G03G 15/02
[52] U.S. Cl. ..... 355/219; 361/225
[58] Field of Search ..... 355/219; 361/225

[56] References Cited

U.S. PATENT DOCUMENTS 5,038,174 8/1991 Kato et al. ..... 355/215
5,384,626 1/1995 Kugoh et al. ..... 355/219
5,390,007 2/1995 Kugoh et al. ..... 355/219

FOREIGN PATENT DOCUMENTS 0576203 12/1993 European Pat. Off. .
61-057958 3/1986 Japan .
5-216326 8/1993 Japan .
06274005 9/1994 Japan .

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

A charging device for charging a member to be charged, includes a charging material for charging the member to be charged, the charging material including a layer of particles capable of being supplied with a voltage and contactable to the member to be charged, wherein the particle layer comprises first particles having a volume resistivity of not less than $6.0\times10^3$ Ohm.cm and less than $1.0\times10^5$ Ohm.cm and second particles having a volume resistivity of not less than $6.3\times10^5$ Ohm.cm mixed with the first particles.

30 Claims, 3 Drawing Sheets

FIG. 3(a)
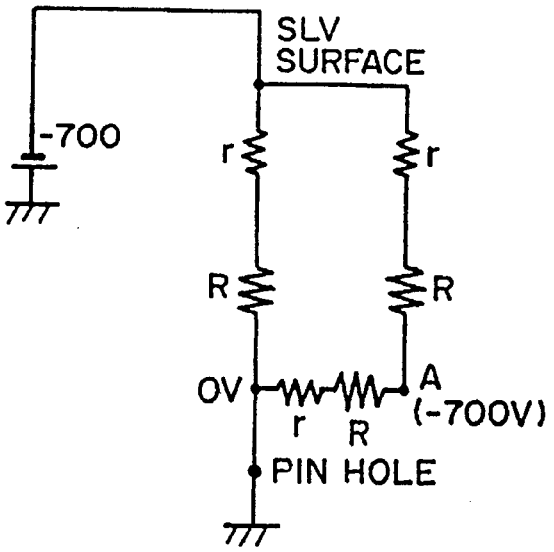
FIG. 3(b)
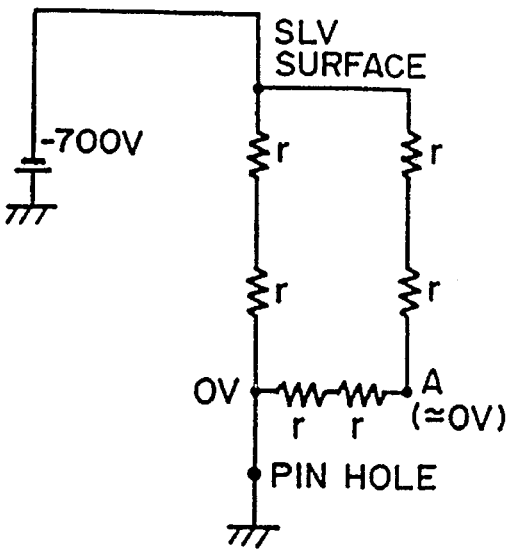
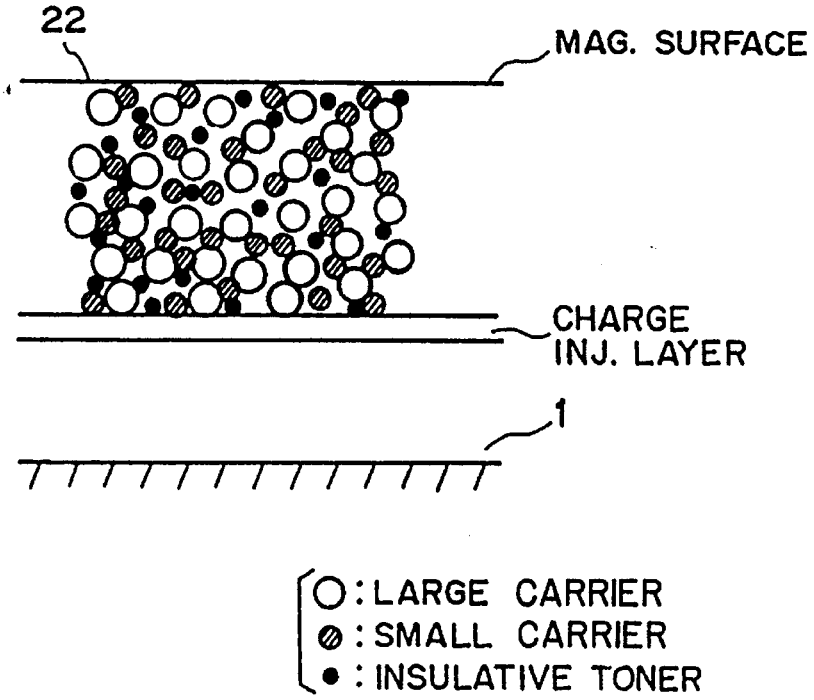
FIG. 4

CHARGING DEVICE

FIELD OF THE INVENTION AND RELATED ART

The present invention relates to a charging device having a charging member or material contactable to a member to be charged such as a photosensitive member or a dielectric member.

The charging device is preferably usable in an image forming apparatus such as a copying machine, printer or the like and a process cartridge detachably mountable to such an image forming apparatus.

EPA 576203 discloses a photosensitive member having a surface charge injection layer, and a contact charging member contactable to the charge injection layer to electrically charge the photosensitive member by charge injection.

Japanese Laid-Open Patent Application No. 57958/1986 discloses the use of a layer of particles forming a magnetic brush as the contact charging member.

As for the charge injection layer of the photosensitive member, a material comprising insulative and light transmitting binder resin and electroconductive fine particles dispersed therein, is preferably usable. When a charging magnetic brush supplied with a voltage is contacted to such a charge injection layer, a great number of such conductive particles exist as if they are float electrodes relative to the conductive base of the photosensitive member, so that it is considered that capacities provided by the float electrodes are electrically charged.

Japanese Laid-Open Patent Application No. 274005/1994 discloses a magnetic brush formed by a mixture of high resistance particles having a volume resistivity of not less than $5\times10^4$ ohm.cm and electroconductive particles having a volume resistivity of not more than $5\times10^3$ ohm.cm.

As for the charge injection layer of the photosensitive member, it is preferably electrically insulative and comprises light transmitting binder and conductive fine particles dispersed therein.

The present invention provides improvement in such a charging device using charging particles.

SUMMARY OF THE INVENTION

Accordingly, it is a principal object of the present invention to provide a charging device or method in which improper charging attributable to foreign matter is effectively prevented.

It is another object of the present invention to provide a charging device and method in which dielectric breakdown of a member to be charged and electric leakage to the member to be charged attributable to the low resistance of the charging material, can be suppressed or prevented effectively.

It is a further object of the present invention to provide a charging device and method in which deposition of charging particles on the member to be charged is effectively prevented.

It is a further object of the present invention to provide a charging device and method in which two or more of the above-described objects are accomplished.

BRIEF DESCRIPTION OF THE DRAWINGS

FIG. 3 illustrates leakage of the current into a pin hole.

FIG. 4 illustrates a situation in which toner is introduced into a charging brush of magnetic particles having different average particle sizes.

DESCRIPTION OF THE PREFERRED EMBODIMENTS

Referring to a accompanying drawings, the description will be made as to the illustrated embodiments of the present invention.

Figure 1:
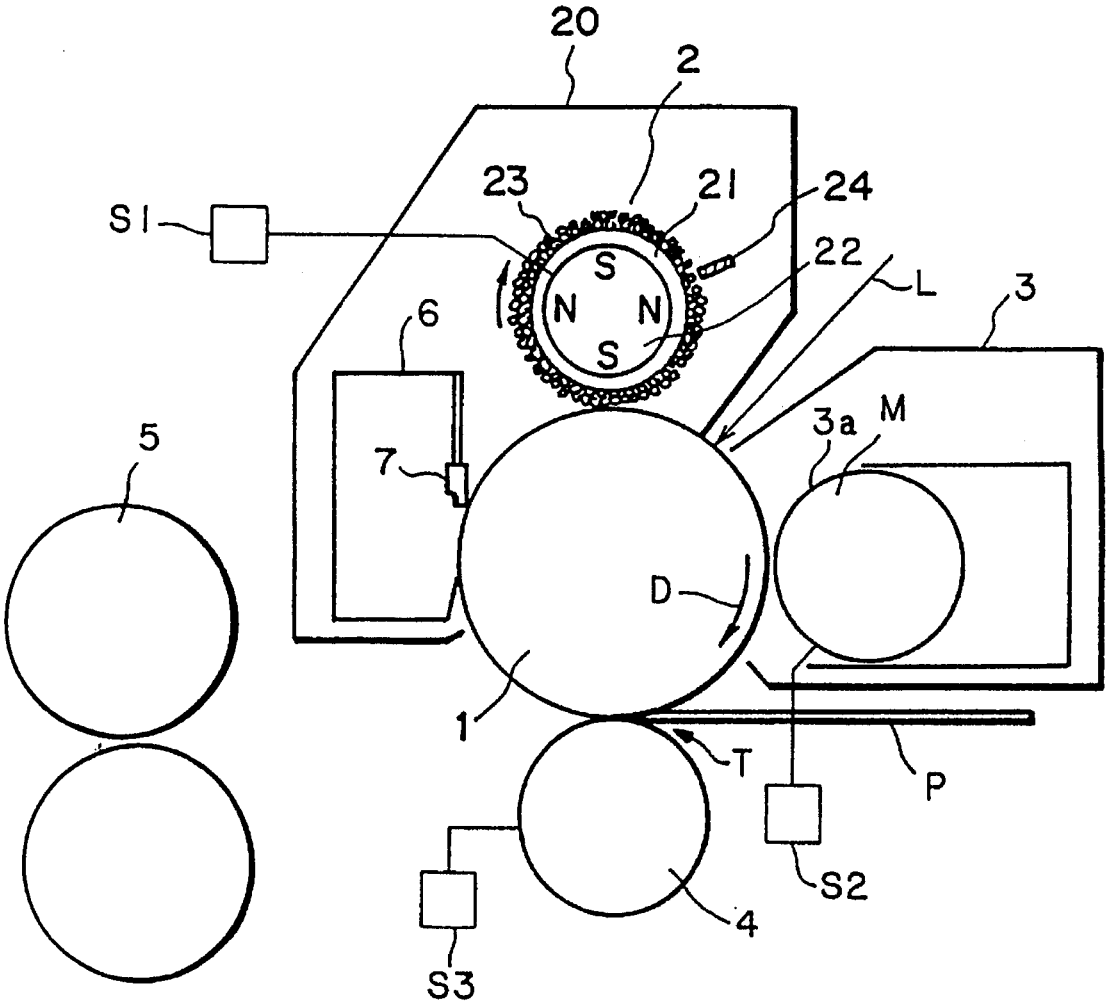
FIG. 1 schematically shows an image forming apparatus.

FIG. 1 is a schematic side view of an image forming apparatus using a charging device according to an embodiment of the present invention. In the embodiment of FIG. 1, the image forming apparatus is shown as an electrophotographic laser beam printer.

Designated by a reference numeral 1 is an image bearing member in the form of a rotatable electrophotographic photosensitive member of a rotatable drum type (photosensitive drum). In this embodiment, it is an OPC photosensitive member having a diameter of 30 mm, and is rotated at a process speed (peripheral speed) of 100 mm/sec in the clockwise direction indicated by an arrow D.

An electroconductive magnetic brush (contact charging member) 2 is contacted to the photosensitive drum 1. Charging magnetic particles 23 are deposited on a rotatable charging sleeve 21 of non-magnetic material by magnetic force provided by a magnet 22. The magnetic brush 2 is supplied with a DC charging bias voltage of −700 V from a charging bias application voltage source S1, so that the outer peripheral surface of the photosensitive member 1 is uniformly charged substantially to −700 V through charge injection charging.

The surface of the photosensitive member 1 thus charged is exposed to scanning light L which is modulated in intensity in accordance with time series electric digital pixel signals indicative of intended image formation, outputted from a laser beam scanner not shown, so that an electrostatic latent image is formed corresponding to the image information intended, on the outer periphery of the photosensitive member 1. The electrostatic latent image is developed into a toner image by a reverse developing device 3 using magnetic one component insulative toner particles charged to a negative polarity. A non-magnetic developing sleeve **3*a* having a diameter of 16 mm and containing a magnet M is coated with the toner charged to a negative polarity. The distance from the surface of the photosensitive member 1 is fixed at 300 μm. The sleeve is rotated at the same peripheral speed as the photosensitive drum 1, and a developing bias voltage is applied to the sleeve 3*a* by a developing bias voltage source S2. The voltage is −500 V (DC) biased with a rectangular AC voltage having a frequency of 1800 Hz and a peak-to-peak voltage of 1600 V, so that so-called jumping development is carried out between the sleeve 3*a* and the photosensitive member 1**.

On the other hand, a transfer material P (recording material) is supplied from an unshown sheet feeding station, and is fed at a predetermined timing to a nip (transfer position) T formed between the photosensitive drum 1 and an intermediate resistance transfer roller 4 (contact transfer means) press-contacted thereto at a predetermined pressure. A predetermined transfer bias voltage is applied to the transfer roller 4 from a transfer bias application voltage source S3.

In this embodiment, the roller has a resistance of $5\times10^8$ ohm, and +2000 V (DC) is applied to transfer the image.

The transfer material P introduced into the transfer position T is nipped and fed by the nip T, by which the toner image is sequentially transferred onto the transfer material P by the electrostatic force and the pressure from the surface of the photosensitive drum 1 onto the surface of the transfer material P.

The transfer material P having received the toner image is separated from the surface of the photosensitive drum 1 and is introduced into a fixing device 5 of heat fixing type, in which the toner image is fixed into a final print (copy).

The surface of the photosensitive drum after the toner image transfer onto the transfer material P, is cleaned by a cleaning device 6 (including a cleaning blade 7) so that residual toner or other contaminants are removed so as to be prepared for repeated image forming operation.

The image forming apparatus of this embodiment uses a process cartridge which contains the photosensitive drum 1, the contact charging member 2, the developing device 3 and the cleaning device 6 (four process means) and which is detachably mountable as a unit to a main assembly of the image forming apparatus. However, the present invention is not limited to the image forming apparatus using the cartridge 20.

A description will be made as to the photosensitive drum used in this embodiment.

The photosensitive member is an OPC photosensitive member negatively chargeable, and comprises an aluminum drum having a diameter of 30 mm and five function layers including a first layer (undercoating layer), a second layer (positive charge injection preventing layer), a third layer (charge generating layer), and a fourth layer (charge transfer layer). In this embodiment, a conventional OPC photosensitive member of the function separation type is used. These layers are not limiting in the present invention; a single layer type OPC, ZnO, selenium, amorphous silicon or the like may be useful for the photosensitive member.

The fifth layer is a charge injection layer comprising photocuring acrylic resin material and $SnO_2$ ultrafine particles dispersed therein. More particularly, $SnO_2$ particles having an average particle diameter of approx. 0.3 μm having a resistance lowered by doping with antimony, are dispersed at a weight ratio of 5:2 relative to the resin material.

The volume resistivity of the charge injection layer changes with a change in the amount of electroconductive $SnO_2$ dispersed therein. In order to prevent "flow" of the image, the resistance of the charge injection layer is preferably not less than $1\times10^8$ ohm.cm. As to the measurement of the resistance of the charge injection layer, the charge injection layer is applied on an insulative sheet, and the surface resistance thereof is measured by a high resistance meter 4329A available from Hewlett Packard with an amplied voltage of 100 V.

The liquid thus prepared is applied by a conventional application method, such as dipping, to a thickness of approx. 3 μm to provide a charge injection layer.

In this embodiment, the volume resistivity of the charge injection layer is $1\times10^{12}$ ohm.cm.

It is preferable that the volume resistivity of the charge injection layer is $1\times10^8$–$1\times10^{15}$ ohm.cm.

A description will be made as to the contact charging member or material.

The electroconductive magnetic brush is constituted by magnetic and electroconductive particles 23 on the non-magnetic and electroconductive sleeve 21 containing a magnet roller 22. The magnet roller 22 is fixed, and the sleeve 21 is rotated such that the sleeve surface moves in the direction opposite that of the photosensitive drum 1 at the closest position therebetween. The magnetic flux density on the sleeve at the closest position is 950 Gauss, and the erection of the magnetic brush is confined by a magnetic blade 24 opposed to the sleeve such that the height of the brush is approx. 1 mm. In the longitudinal direction (the direction perpendicular to the sheet of the drawing), the width in which the charging magnetic particles of the magnetic brush are deposited, is 200 mm, and the amount of the magnetic particles of the magnetic brush is approx. 10 g. The gap between the charging sleeve 21 and the photosensitive drum 1 is 500 μm.

A peripheral speed ratio between the sleeve and the photosensitive member will be described.

The peripheral speed ratio is defined as follows:

Peripheral speed ratio (%)=(peripheral speed of magnetic brush—drum peripheral speed)/drum peripheral speed×100

The speed ratio is preferably large from charge standpoint of enhancing the desired charge injection, but is preferably as low as possible provided that the injection property is assured, from the standpoint of the cost or safety. In practice, if the magnetic brush is co-directionally contacted to the photosensitive member (the peripheral surfaces of the sleeve and the photosensitive member move in the same direction at the position where they are closest) at a low peripheral speed ratio, the magnetic particles of the magnetic brush are relatively easily deposited on the drum, and therefore, it is preferably larger than ±100%. However, −100% means the brush is at rest, and in this case, the non-uniformness of contact of the particles on the surface of the photosensitive member appears in the image due to non-uniform charging.

In consideration of this, in this embodiment, the peripheral speed ratio between the surface of the sleeve and the surface of the photosensitive member is such that the surface of the sleeve is moved at the speed of 150% of the speed of the photosensitive member in the direction opposite from that of the photosensitive member at the closest position between the sleeve and the photosensitive member.

In this embodiment, the voltage (V) applied to the charging member and the potential (V) of the photosensitive member are related with each other with direct proportion relationship of the inclination of 1, preferably.

A description will be made as to the magnetic particles used in this embodiment. In this embodiment, the magnetic particles contain two kinds of magnetic particles, namely, "A" particles of relatively low resistance and "B" particles of intermediate resistance.

A particles include magnetite particles (saturated magnetization of 59.6 $A.m^2/kg$) having an average particle size of 25 μm and a volume resistivity of $8\times10^6$ ohm.cm.

B particles include ferrite particles (saturated magnetization of 58.0 $A.m^2/kg$) having an average particle size of 25 μm and a volume resistivity of $6\times10^7$ ohm.cm.

A description will be made as to the measuring method for the average particle size and the resistance of the particles.

As for the measurement of the particle size (diameter), at least 100 particles are picked up at random using an optical microscope or a scanning type electronic microscope, and the volume particle size distribution is calculated with horizontal maximum span length, and the average particle size is defined as the average particle size at 50% of the entire volume. As an alternative, a laser refraction type particle size distribution measuring device AEROS (available from Japan Denshi Kabushiki Kaisha) may be used; a particle size range between 0.05–200 μm is divided into 32 sections, and the average particle size may be defined as the average particle size at 50% of the volume distribution.

As to the resistance of the particles, 2 g of magnetic particles are placed in a cylindrical container having a bottom area of 227 $mm^2$ and are pressed at 6.6 $kg/cm^2$. A voltage of 100 V is applied between the top and the bottom. The resistance is calculated on the basis of the current therethrough, and the data are regulated.

The saturated magnetization of the particles were measured, using a magnetic property automatic recording device of the oscillating magnetic field type BHV-30 available from Riken Denshi Kabushiki Kaisha, Japan. As for the measurement for the magnetic property of the carrier powder, an external magnetic field of ±1 k.Oersted is formed, and on the basis of the hysteresis curve with the external magnetic field, the intensity of the magnetization at the magnetic field of 1 k.Oersted is determined.

Resultant images using magnetic brushes with different mixture ratio (weight ratio of A particles on the basis of the entire weight), a magnetic brush using only A particles, and a magnetic brush using only B particles, were compared. The images were produced using the image forming apparatus described hereinbefore. In order to investigate the charging performance of the magnetic particles, the charged potentials were measured. The charge potential of the photosensitive member after it passes once the charging position relative to the voltage applied to the sleeve, is defined as the potential conversion rate to be used as indexes of the charging properties. The potential converging rate of not less than 95% is of practically no problem.

The results of experiments are given in Table 1.

TABLE 1

| Mixing Ratio (wt. %) | Pin Hole Leak | Charging Property (Potential Conv.) PS = 100 mm/sec |
|---|---|---|
| 0 (only B) | G | 85 (%) |
| 5 | G | 95 |
| 10 | G | 100 |
| 20 | G | 100 |
| 30 | F | 100 |
| 40 | F | 100 |
| 100 (only A) | NG | 100 |

NG: No good
F: Fair
G: Good

In the above Table, "NG" means occurrence of improper charging in the form of black stripes, "F" means substantially satisfactory although smear appears around a pin hole, but practically usable.

From the above Table, it is understood that the conversion property is not satisfactory when B particles alone are used. On the other hand, pin hole leakage occurs if A particles alone are used. It is further understood that both desired qualities can be satisfied using a mixture of A and B particles. With an increase of the content (mixture ratio) in the low resistance A particles, electric current paths are constituted only by low resistance A particles, among the particles with the possible result of pin hole leakage. From this standpoint, the content of the A particles is preferably 40% by weight or lower. In order to provide good charging performance, the content of A particles is not less than 5% by weight.

The images are evaluated and potentials are measured under the conditions that the mixture ratio is fixed at 10% by weight, the same B particles are used, and different resistances of the A particles are used.

Table 2 shows the results.

TABLE 2

| Resistance ohm · cm | Pin Hole Leak | Charging Property (Potential Conv.) PS = 100 mm/sec |
|---|---|---|
| $3.5 \times 10^3$ | NG | 100 (%) |
| $6.0 \times 10^3$ | G | 100 |
| $8.9 \times 10^3$ | G | 100 |
| $1.7 \times 10^4$ | G | 100 |
| $9.5 \times 10^4$ | G | 100 |
| $1.0 \times 10^5$ | G | 90 |

NG: No good
F: Fair
G: Good

From the Table 2; it is understood that if the resistance of the low resistance particles is too low, the particles tend to be deposited on the photosensitive member, with the result of improper image formation. The reason for this is considered as follows. Because the resistance of the particles is low, the electric charge is relatively easily induced in the particles contacted to the drum, and therefore the particles are deposited by a force received by the charge from the electric field. When the particles are deposited on the drum, the image light is blocked by the deposited particles in the image exposure station, with the result of improper image formation. When the particles are mixed into the developing device, a development leakage or fog image will be produced. When the particles are transferred onto the transfer material from the drum, the image is not properly fixed on the transfer material, with the result of a highly rough image.

When amount of the particles is reduced, the magnetic brush becomes unable to uniformly contact the drum, and an improper contact portion results in formation of an improper charging, and therefore, improper image. Here, as indexes for the deposition, "NG" means occurrence of improper charging at 1000 printing on A4 size transfer material. When the resistance is $3.5\times10^3$ ohm.cm, deposition is remarkable with the result of occurrence of improper charging at 800 printing operations.

When the resistance of the low resistance particles is high, the potential converging property becomes worse. When it is $1.0\times10^5$ ohm.cm, the conversion property is 90% which is low enough to bring about improper charging. Here, improper charging does not mean partial improper charging resulting from insufficiency of contact of the magnetic brush, but means uniform insufficient charging in an area where exposure is effected previously.

From the foregoing, the resistance of the low resistance particles is preferably not less than $6.0\times10^3$ ohm.cm and less than $1.0\times10^5$ ohm.cm.

Next, the experiments that have been carried out with the resistance and content of the low resistance particles described changed, without changing the B particles.

Figure 2:
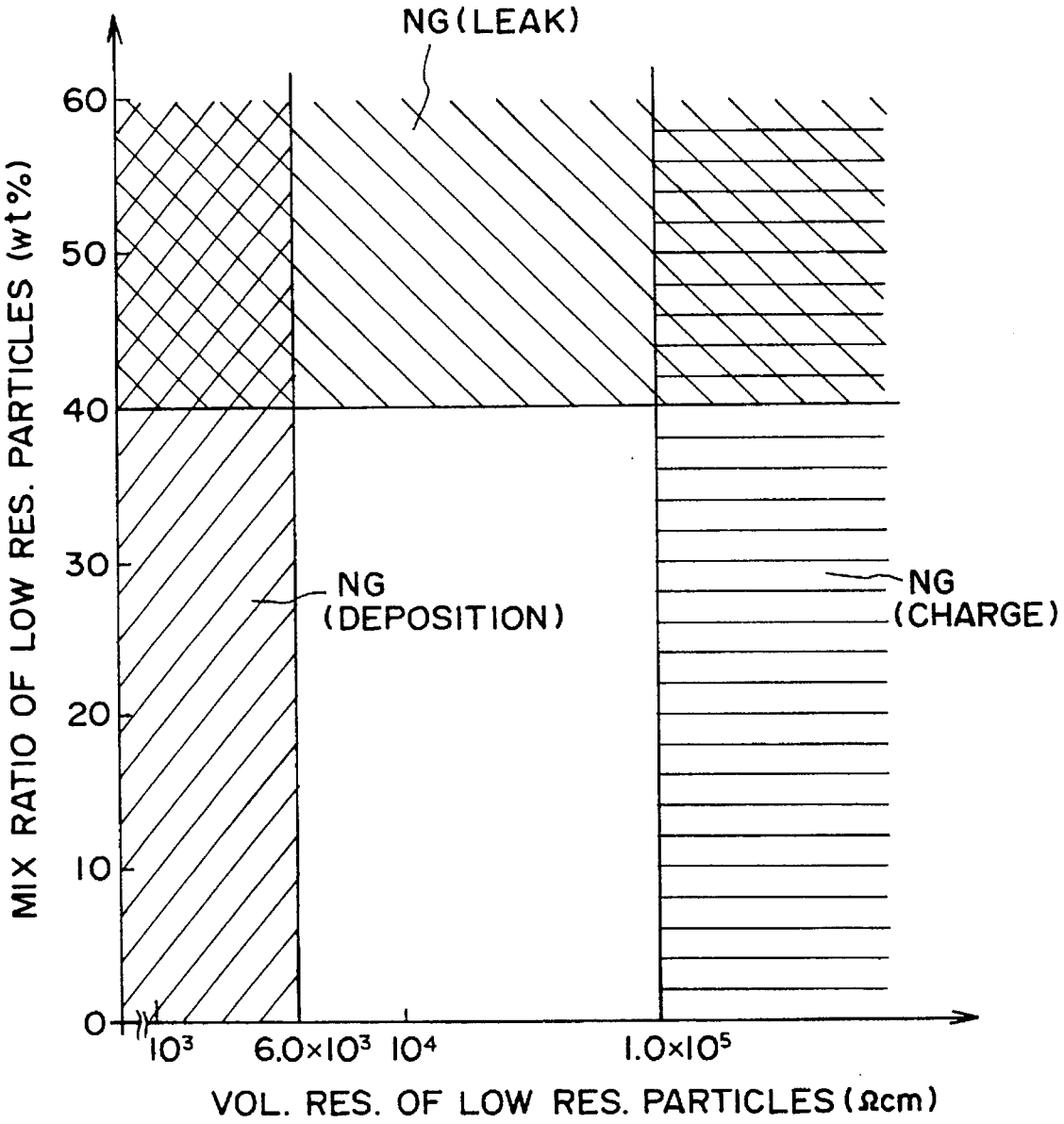
FIG. 2 is a graph showing a relationship between a mixture ratio and a volume resistivity of low resistance particles.

The results are shown in FIG. 2.

As will be understood from FIG. 2, from the standpoints of all of the deposition of the particles on the photosensitive member, the charging property of the photosensitive member and the current leakage to the photosensitive member, the volume resistivity of the low resistance material is not less than $6.0\times10^3$ ohm.cm and is less than $1.0\times10^5$ ohm.cm, and the content of the low resistance particles in the entirety of the particles is 40% by weight or lower, preferably.

Furthermore, the volume resistivity X (ohm.cm) of the low resistance particles, and the content Y (% by weight) of the low resistance material in the entire particles, preferably satisfy:

$$Y \leqq 15+2.5 \log_{10} X.$$

Further experiments are carried out with low resistance particles of $9.5\times10^4$ ohm.cm and a mixture ratio thereof of 30%, with the changed resistance of the intermediate particles. The potentials were measured.

TABLE 3

| Resistance ohm · cm | Pin Hole Leak | Charging Property (Potential Conv.) PS = 100 mm/sec |
|---|---|---|
| $8.7\times10^4$ | NG | 100 (%) |
| $6.3\times10^5$ | F | 100 |
| $1.3\times10^8$ | G | 100 |
| $6.9\times10^7$ | G | 100 |
| $6.7\times10^9$ | G | 95 |

NG: No good
F: Fair
G: Good

From the above Table 3, it is understood that if the resistance of the intermediate resistance material is low, leakage occurs at a pin hole in the drum. On the other hand, if the resistance of the intermediate resistance layer is high, the charging property is not significantly deteriorated even if it is slightly high. The reason is believed to be that the mixed low resistance particles assure the electrical current paths. In the case of the conventional intermediate resistance particles, a value of $1\times10^8$ ohm.cm or higher results in improper charging. Therefore, it is understood that the usable range of the intermediate resistance particles is widened by the mixture of the particles.

From the foregoing, the resistance of the intermediate resistance particles is not less than $6.3\times10^5$ ohm.cm, preferably not less than $1.0\times10^6$ ohm.cm.

The resistance of the intermediate resistance particles is preferably less than $1.0\times10^{10}$ ohm.cm. The advantageous effects of this embodiments will be described. Durability against pin hole leakage is shown in FIG. 3. When a charging member r having a low volume resistivity, is used charging current flows concentratedly to the pin hole in the photosensitive member, as shown in FIG. 3(*b*). Therefore, the potential at point A as well as the potential at the pin hole decrease to substantially 0 V which is the potential of the base member of the photosensitive member with the result of improper charging at the point A. This is because the resistance of the magnetic particles existing between the point A and the pin hole is only 2r in FIG. 3(*b*). In order to prevent this, the resistance of the charging member is preferably $1\times10^5$ ohm.cm or higher. On the other hand, in direct charge injection charging, the charge is directly injected into the charge injection layer on the surface of the photosensitive member from the surfaces of the magnetic particles, and therefore, the charge injection property is improved by use of a low resistance charging member. The reasons are believed to be as follows. The time constant of the charge injection decreases with a decrease in the resistance of the magnetic particles, and the contact resistance at the interface between the charging particles and the photosensitive member is low.

Therefore, it has been difficult to satisfy both durability against pin hole leakage and proper charge injection, when the charging is carried out with magnetic particles having a substantially single resistance distribution as in the prior art.

However, by using magnetic particles having a different resistance distribution, the co-existence of low resistance and intermediate resistance magnetic particles results in macroscopic resistance that is determined by the magnetic particles having higher resistance, and therefore, the charging current is not concentrated at the pin hole in the photosensitive member.

More particularly, as shown in FIG. 3(*a*), the resistance of the magnetic particles between the point A and the pin hole is intermediate to prevent potential drop of the point A (from R+r to R).

In the area where the low resistance magnetic particles and the photosensitive member are contacted, the injection time constant is small, and in addition, the electric resistance at the interface is small, and therefore, a charge is injected into the photosensitive member, thus accomplishing satisfactory charging.

On the other hand, by using not less than $10^3$ ohm.cm as the resistance of the low resistance material, deposition of the particles does not occur, while the low resistance particles are relatively easily deposited on the drum.

In this embodiment, two different resistance magnetic particles are mixed, but three or more kinds of magnetic particles having different resistances are usable a broader distribution of resistances of the magnetic particles is usable with the same advantageous effects.

In this embodiment, either the same ferrite particles but with different surface treatment, or magnetite are used to provide different resistance particles. However, other materials are usable, which include particles formed from kneaded resin material and magnetic powder such as magnetite, a material comprising electroconductive carbon or the like for adjustment of the resistance, sintered ferrite, any one of the above materials reduced for adjustment of the resistance, such a magnetic particle treated for proper resistance by plating, coating with resistance, adjusted resin.

As described in the foregoing, with the structure of this embodiment, pin hole leakage can be effectively prevented with proper level of the charging property. By using $6.0\times10^3$ ohm.cm or higher as the resistance of low resistance particles, the deposition of the particles can be prevented.

By a combination of the charging member of this embodiment and the charge injection layer of the photosensitive member having the resistance of $1\times10^8$–$1\times10^{15}$ ohm.cm, a photosensitive member can be sufficiently uniformly charged for a short period of time required in an electrophotographic process, without flow of the image. Additionally, a proper charging property can be obtained since particle deposition does not occur.

The material of the photosensitive member is not limited to OPC; satisfactory charge injection can be carried out by using a charging member of this embodiment. More particularly, the drum surface was charged to 480 V with the voltage of 500 V applied to the sleeve.

By using direct charge injection, the conventional problems of ozone production and photosensitive member surface deterioration can be eliminated for long term use.

Embodiment 2

In this embodiment, the magnetic particles constituting the charging magnetic brush comprise particles having different resistances, and the average particle size of the low resistance particles is smaller than that of the higher resistance particles.

In conventional contact charging, in which the charges are moved using electric discharge, the charge can move and therefore charging occurs even if a gap is produced between the photosensitive member and between the magnetic particles if the gap is a dischargeable gap.

However, in direct injection charging, the electric charge moves through the electroconductive paths between magnetic particles, and the electric charge is injected by direct contact between the magnetic particles and the charge injection layer of the surface of the photosensitive member. Therefore, when insulative foreign matter such as toner or the like is mixed into the magnetic powder as a result of long term use, or when the resistance of the surfaces of the magnetic particles are increased by toner fusing thereon or the like, the electroconductive paths are isolated with the result of uncharged or unsatisfactorily charged microscopic areas occur on the photosensitive member under such a situation, improper charged areas appear as black spots in a reverse-development electrophotographic process. Macroscopicly, a portion where the potential is attenuated by previous image exposure or the like, becomes black (charge positive ghost).

In order to suppress this, the average particle size may be reduced in order to increase the chances of contacts between the charging particles and the photosensitive member and between the magnetic particles. However, a reduction in the average particle size results in a reduction in the magnetic confining forces of the individual particles, and therefore, the magnetic particles are deposited on the photosensitive member.

In consideration of the above, in this embodiment of the present invention the average particle size of the relatively low resistance particles is smaller than the relatively high resistance particles, thus providing immunity against insulative foreign matter and deposition of the magnetic particles.

In this embodiment, intermediate resistance B particles as used in Embodiment 1 and C particles are used as the low resistance particles. The B particles are ferrite particles having a volume resistivity $6.4\times10^7$ ohm.cm and an average particle size 25 μm. The C particles include magnetite particles having a volume resistivity of $8.9\times10^4$ ohm.cm and having an average particle size of 10 μm. These particles are mixed at a ratio of B:C=9:1 (the content of C particles in 10% by weight), and a magnetic brush is formed by the mixture of the particles.

The particle size (average particle diameter) and the resistance are the measured by the same method as in Embodiment 1.

When particles having different average particle diameters are used, the following advantage is provided. Even if the insulative material such as toner or paper dust is introduced in the long term use, with the result of blocking electric conduction between the magnetic particles and/or between the magnetic particles and the photosensitive drum, an electrically conductive path is formed by the small particle diameter particles between the large diameter magnetic particles, as shown in FIG. 4, thus assuring the electric path, and therefore, preventing improper charging.

Between the magnetic particles and the photosensitive drum, the existence of small diameter particles functions, in effect, to increase the nip between the magnetic particles and the photosensitive member, and therefore, the charging property is further improved.

By combining large size particles and small size particles, the small size particles are magnetically and physically confined on the large size particles so that magnetic particles deposition is suppressed.

In this case, as has been described in Embodiment 1, even if the volume resistivity of one kind of particles is low, the resistance of the entirety of the magnetic particles is substantially determined by the particles having a high volume resistivity, and therefore, the resistivity against pin hole leakage can be maintained. Therefore, the resistance of magnetic particles of the small size particles constituting the electroconductive paths is preferably smaller than that of the large size particles.

Experiments have been carried out with the same conditions as in Embodiment 1, except for the magnetic particles of this embodiment (100 mm/sec of the process speed), and the printing durability test was carried out. Proper charging properties were confirmed for 10,000 sheets of A4 size.

The magnetic particles after processing of 10,000 sheets, were observed by an electronic microscope. Although toner particles are mixed into the magnetic particles, the small size electroconductive magnetic particles existed between or among large size magnetic particles, thus maintaining the electroconductive paths. Since the small size magnetic particles increase the flowability of the entirety of the magnetic particles, and also since the small size particles function as cushions to reduce shearing between the magnetic particles, hardly any fusing of the toner on the large magnetic particles was recognized.

COMPARISON EXAMPLE 1

"Ferrite"; magnetic particles having an average particle size of 15 microns, and a volume resistivity of $6.9\times10^7$ Ohm.cm, were used for the charging material.

At the initial stage, uniform charging was carried out, and good images were formed. However, after 4000 sheets were processed, improper charging occurred. More particularly, charge ghost appeared in the reverse development.

COMPARISON EXAMPLE 2

Ferrite magnetic particles having an average particle size of 15 microns and a volume resistivity of $6.9\times10^7$ Ohm.cm, and ferrite magnetic particles having an average particle size of 10 microns and a volume resistivity of $6.9\times10^7$ Ohm.cm, were mixed with a mixing ratio of 10:1 by weight (9.1% by weight).

Using the mixture, the charge ghost occurred when 5000 sheets were processed.

COMPARISON EXAMPLE 3

Ferrite magnetic particles having an average particle size of 10 microns, and a volume resistivity of $6.9\times10^7$ Ohm.cm, were used for the charging material.

Improper charging occurred due to a reduction of amount of the particles when 1000 sheets were processed.

As regards the charging ghost, a solid black image is formed, and thereafter, a solid white image is formed. Then, the density of an after-solid-black background fog attributable to insufficient charging is measured after one full-rotation of the photosensitive drum by a Macbeth densitometer (RD-1255, available from Macbeth), and the measured density is taken as indexes for the charging property. It has been confirmed that the density of the fog increases with the number of the processing operation in the comparison examples 1 and 2.

The surfaces of the magnetic particles in; comparison examples 1 and 2 were observed by electronic microscope. The introduction of toner particles into the magnetic particles was confirmed. When the operation was continued, the toner and the like were fused on the surface of the magnetic particles. This impedes the motion of the electric charge in the magnetic powder.

A description will be made as to a preferable relationship between the resistance and the average particle size of the low resistance magnetic particles found by the inventors.

Table 4 shows the results of experiments using intermediate resistance magnetic particles of ferrite particles (average particle size: 50 microns) having a volume resistivity of $6.7\times10^9$ Ohm.cm, 10% by weight of low resistance magnetic particles having different volume resistivity and average particle size. Images were formed with the mixture.

TABLE 4

| | Resistance (ohm · cm) | | | | |
|---|---|---|---|---|---|
| Diameter (μm) | $3.5\times10^3$ | $8.9\times10^3$ | $1.7\times10^4$ | $9.5\times10^4$ | $5.7\times10^5$ |
| 1 | DEP: NG | G | G | F | POT. CONV.: NG |
| 10 | DEP: NG | G | G | F | POT. CONV.: NG |
| 15 | DEP: NG | G | G | F | POT. CONV.: NG |
| 20 | DEP: NG | F | F | F | POT. CONV.: NG |
| 30 | DEP: NG | F | F | F | POT. CONV.: NG |
| 40 | DEP: NG | | | | POT. CONV.: NG |
| | CHRG UNI.: NG | CHRG UNI.: NG | CHRG UNI.: NG | CHRG UNI.: NG | CHRG UNI.: NG |

NG: No good,
F: Fair,
G: Good,
E: Excellent

From the above table, it is understood that substantially satisfactory charging property without charging ghost was provided even when 5000 sheets were continuously processed, if the volume resistivity of the low resistance magnetic particles to be mixed is less than $1\times10^5$ Ohm.cm, and the average particle size is no more than 30 microns. Furthermore, satisfactory charging property without charging ghost was provided even when 10000 sheets were continuously processed, if the volume resistivity of the low resistance magnetic particles to be mixed is less than $5\times10^4$ Ohm.cm, and the average particle size is no more than 15 microns.

Table 5 shows the results in the case of intermediate resistance magnetic particles of ferrite magnetic particles having a volume resistivity of $6.9\times10^7$ Ohm.cm.

TABLE 5

| | Resistance (ohm · cm) | | | | |
|---|---|---|---|---|---|
| Diameter (μm) | $3.5\times10^3$ | $8.9\times10^3$ | $1.7\times10^4$ | $9.5\times10^4$ | $5.7\times10^5$ |
| 1 | DEP: NG | E | E | G | POT. CONV.: NG |
| 10 | DEP: NG | E | E | G | POT. CONV.: NG |
| 15 | DEP: NG | E | E | G | POT. CONV.: NG |
| 20 | DEP: NG | G | G | G | POT. CONV.: NG |
| 30 | DEP: NG | G | G | G | POT. CONV.: NG |
| 40 | DEP: NG | | | | POT. CONV.: NG |
| | CHRG UNI.: NG | CHRG UNI.: NG | CHRG UNI: NG | CHRG UNI.: NG | CHRG UNI.: NG |

NG: No good,
F: Fair,
G: Good,
E: Excellent

From the above table, it is understood that satisfactory charging property without charging ghost was provided even when 10000 sheets were continuously processed, if the volume resistivity of the low resistance magnetic particles to be mixed is less than $1\times10^5$ Ohm.cm, and the average particle size is no more than 30 microns.

Furthermore, excellent charging property without charging ghost was provided even when 10000 sheets were continuously processed, if the volume resistivity of the low resistance magnetic particles to be mixed is less than $5\times10^4$ Ohm.cm, and the average particle size is no more than 15 microns.

As described above, the problems, with the prior art, of contamination of the magnetic powder and/or improper charging have been significantly solved by using a mixture of intermediate resistance magnetic particles having a large particle size and low resistance magnetic particles having a small particle size, as the charging member. The low resistance magnetic particles having a small particle size preferably have a volume resistivity of not less than $6.0\times10^3$ Ohm.cm and less than $1.0\times10^5$ Ohm.cm from the standpoint of deposition prevention and charging property, and preferably have an average particle size of not more than 30 microns. The intermediate resistance magnetic particles having a large particle size preferably have a volume resistivity of not less than $6.3\times10^5$ Ohm.cm from the standpoint of pin hole prevention.

Furthermore, the intermediate resistance magnetic particles having a large particle size preferably have a volume resistivity of less than $1\times10^{10}$ Ohm.cm, and preferably have an average particle size of not less than 15 microns and not more than 100 microns from the standpoint of deposition prevention and charge uniformity.

In the foregoing embodiment, a description will be made as to two kinds of different particle size particles, but three or more kinds of particles are usable. Additionally, deposition prevention and satisfactory charging property effects are provided by using a broad particle size distribution having the particle size ranges described above.

EMBODIMENT 3

In this embodiment, lubricating particles are dispersed in order to decrease the surface energy of the charge injection layer at the outer surface of the photosensitive member. By doing so, disengagement of particularly the small particle size particles from the magnetic brush occurs due to the molecular forces between the magnetic particles and the photosensitive member. In this embodiment, PTFE particle (Teflon, available from Dupont) having an average particle size of 0.3 microns are added (30% by weight relative to the binder).

In the case that Teflon particles or the like are dispersed in the charge transfer layer for the purpose of providing the photosensitive member with the lubricity, the amount thereof is relatively small, since they may scatter the image light in consideration of the fact that the thickness of the charge transfer layer is as large as 20 microns, for example.

However, the charge injection layer has a small thickness such as 2–3 microns, and light scattering may not be signifcantly taken into account, and therefore, the amount thereof may be 30%.

In this embodiment, Teflon particles are dispersed as the lubricant in the charge injection layer, so that the surface energy of the charge injection layer is lowered, and therefore, the parting property of the particles is improved. Thus, deposition of the particles having small particle size can be significantly reduced as compared with the case of no lubricant dispersed.

The Ferrite particles (magnetic particles) having a particle size of 15 microns and magnetite particles having a particle size of 1 micron—were mixed with ratio of 20:1, and the mixture was used with a photosensitive drum in which no lubricant is dispersed. After 1000 sheets were processed, the ratio of the particles was measured. It has been confirmed that the amount of magnetite particles of 1 micron has reduced to 1000:1, and fog due to deterioration of the charging property has increased.

However, in the case of the combination of the photosensitive drum and the mixture of particles having Teflon dispersed, the charging property was maintained good, and the ratio of the particles hardly changed, even after 1000 sheets were processed.

In this embodiment, the Teflon material particles are dispersed as the lubricant. However, similar advantageous effects were provided even when polyolefin or silicone particles are dispersed.

While the invention has been described with reference to the structures disclosed herein, it is not confined to the details set forth and this application is intended to cover such modifications or changes as may come within the purposes of the improvements or the scope of the following claims.

What is claimed is:

1. A charging device for charging a member to be charged, comprising:

charging material for charging the member to be charged, said charging material including a layer of particles capable of being supplied with a voltage and contactable to the member to be charged, said particle layer comprising first particles having a volume resistivity of not less than $6.0\times10^3$ Ohm.cm and less than $1.0\times10^5$ Ohm.cm and second particles having a volume resistivity of not less than $6.3\times10^5$ Ohm.cm mixed with said first particles.

2. A device according to claim 1, wherein a content of said first particles is not more than 40% by weight on the basis of the weight of the particle layer.

3. A device according to claim 1 or 2, wherein an average particle size of said first particles is smaller than an average particle size of the second particles.

4. A device according to claim 3, wherein the first particles have an average particle size of less than 30 microns.

5. A device according to claim 1 or 2, wherein said second particles have a volume resistivity of less than $1.0\times10^{10}$ Ohm.cm.

6. A device according to claim 1 or 2, wherein said charging material is movable, and a peripheral speed of said charging member is different from a peripheral speed of the member to be charged.

7. A device according to claim 1 or 2, wherein the first particles are made of magnetite, and the second particles are made of ferrite.

8. A device according to claim 1 or 2, wherein the member to be charged comprises a charge injection layer having a volume resistivity of $1.0\times10^8$–$1.0\times10^{15}$ Ohm.cm.

9. A device according to claim 1 or 2, wherein a content of the first particles is not less than 5% by weight of the particle layer.

10. A device according to claim 1, wherein a volume resistivity×Ohm.cm. of the first particles and a weight ratio y of the first particles relative to that of the particle layer, satisfy:

$$y \leqq 15+2.5 \log_{10} x.$$

11. A device according to claim 8, wherein the member to be charged comprises a photosensitive layer inside the charge injection layer, and said charge injection layer transmits light and comprises an insulative binder and electroconductive fine particles dispersed therein.

12. A device according to claim 11, wherein the charge injection layer comprises lubricant particles dispersed therein.

13. A device according to claim 12, wherein the lubricant particles are made of fluorine resin, polyolefine resin or silicone resin material.

14. A device according to any one of claims 1, 2, 10 and 12, wherein said first particles and said second particles are magnetic particles.

15. A device according to claim 1, wherein the member to be charged is an electrophotographic photosensitive member.

16. A device according to claim 15, wherein the member to be charged and said charging device are disposed in a process cartridge detachably mountable to a main assembly of an image forming apparatus.

17. A device according to claim 3, wherein said first particles and said second particles are magnetic particles.

18. A device according to claim 4, wherein said first particles and said second particles are magnetic particles.

19. A device according to claim 5, wherein said first particles and said second particles are magnetic particles.

20. A device according to claim 7, wherein said first particles and said second particles are magnetic particles.

21. A device according to claim 8, wherein said first particles and said second particles are magnetic particles.

22. A device according to claim 9, wherein said first particles and said second particles are magnetic particles.

23. A device according to claim 11, wherein said first particles and said second particles are magnetic particles.

24. A device according to claim 17, wherein the member to be charged and said charging device are disposed in a process cartridge detachably mountable to a main assembly of an image forming apparatus.

25. A device according to claim 18, wherein the member to be charged and said charging device are disposed in a process cartridge detachably mountable to a main assembly of an image forming apparatus.

26. A device according to claim 19, wherein the member to be charged and said charging device are disposed in a process cartridge detachably mountable to a main assembly of an image forming apparatus.

27. A device according to claim 20, wherein the member to be charged and said charging device are disposed in a process cartridge detachably mountable to a main assembly of an image forming apparatus.

28. A device according to claim 21, wherein the member to be charged and said charging device are disposed in a process cartridge detachably mountable to a main assembly of an image forming apparatus.

29. A device according to claim 22, wherein the member to be charged and said charging device are disposed in a process cartridge detachably mountable to a main assembly of an image forming apparatus.

30. A device according to claim 23, wherein the member to be charged and said charging device are disposed in a process cartridge detachably mountable to a main assembly of an image forming apparatus.

* * * * *

UNITED STATES PATENT AND TRADEMARK OFFICE

CERTIFICATE OF CORRECTION

PATENT NO. : 5,579,095

DATED : November 26, 1996

INVENTOR(S) : HIDEYUKI YANO, ET AL.

It is certified that error appears in the above-indentified patent and that said Letters Patent is hereby corrected as shown below:

COLUMN 1:

Line 12, "like" should read --like,--.

COLUMN 2:

Line 12, "the" should read --a--.

COLUMN 4:

Line 22, "charge" should read --the--;
Line 23, delete "the desired"; and
Line 24, "the" should read --the desired charge--.

COLUMN 5:

Line 11, "were" should read --was--; and
Line 21, "ratio" should read --ratios--.

COLUMN 6:

Line 18, delete "the" (first occurrence); and
Line 56, delete "described", and change "particles" to --particles, are described--.

COLUMN 7:

After Line 10, insert --Table 3 shows the results.--;
Line 41, "embodiments" should read --embodiment--;
Line 43, "resistivity, is used" should read --resistivity is used,--;

UNITED STATES PATENT AND TRADEMARK OFFICE

CERTIFICATE OF CORRECTION

PATENT NO. : 5,579,095

DATED : November 26, 1996

INVENTOR(S) : HIDEYUKI YANO, ET AL.

It is certified that error appears in the above-indentified patent and that said Letters Patent is hereby corrected as shown below:

COLUMN 8:

Line 24, "usable" should read --usable, and a--.

COLUMN 9:

Line 2, delete "between";
Line 12, "are" should read --is--;
Line 15, "occur" should read --occurring--, and "member under" should read --member. Under--;
Line 16, "improper" should read --improperly--;
Line 42, "in" should read --is--; and

COLUMN 10:

Line 12, delete "the";
Line 15, "sheets," should read --sheets--;
Line 29, ""Ferrite";" should read --Ferrite--;
Line 52, "of" should read --in the--;
Line 58, "full-" should read --full--; and
Line 65, "in;" should read --in--.

COLUMN 11:

Table 4, "No good," should read --No good--, "Fair," should read --Fair--, and "Good," should read --Good--; and
Table 5, "No good," should read --No good--, "Fair," should read --Fair--, and "Good," should read --Good--.

UNITED STATES PATENT AND TRADEMARK OFFICE

CERTIFICATE OF CORRECTION

PATENT NO. : 5,579,095 Page 3 of 3

DATED : November 26, 1996

INVENTOR(S) : HIDEYUKI YANO, ET AL.

It is certified that error appears in the above-indentified patent and that said Letters Patent is hereby corrected as shown below:

COLUMN 13:

Line 15, "particle" should read --particles--;
Line 37, delete "The";
Line 39, "micron-were" should read --micron were--; and
Line 48, "the charging property was maintained good" should read --good charging property was maintained--.

Signed and Sealed this

Fifth Day of May, 1998

Bruce Lehman

*Attest:*

BRUCE LEHMAN

*Attesting Officer*

*Commissioner of Patents and Trademarks*